US007090052B2

(12) United States Patent
Arnault et al.

(10) Patent No.: US 7,090,052 B2
(45) Date of Patent: Aug. 15, 2006

(54) METHOD OF MANUFACTURING A VERTICAL SCAFFOLDING ELEMENT, AND ELEMENT THUS OBTAINED

(75) Inventors: Francis Arnault, Venizy (FR); Jean-Pierre Sarrazy, Andresy (FR)

(73) Assignee: Entrepose Echafaudages, Colombes (FR)

( * ) Notice: Subject to any disclaimer, the term of this patent is extended or adjusted under 35 U.S.C. 154(b) by 185 days.

(21) Appl. No.: 10/244,613

(22) Filed: Sep. 17, 2002

(65) Prior Publication Data

US 2004/0050622 A1 Mar. 18, 2004

(51) Int. Cl.
*E04G 7/00* (2006.01)

(52) U.S. Cl. ..... 182/186.8; 403/49

(58) Field of Classification Search ..... 182/179.1, 182/178.1, 186.7, 186.8; 403/49
See application file for complete search history.

(56) References Cited

FOREIGN PATENT DOCUMENTS

| | | |
|---|---|---|
| FR | 1.553.487 | 12/1968 |
| GB | 2 207 875 | 2/1989 |

*Primary Examiner*—Alvin Chin-Shue
(74) *Attorney, Agent, or Firm*—Douglas E. Jackson; Stites & Harbison PLLC

(57) ABSTRACT

The invention relates to a vertical scaffolding element consisting of a tubular portion provided with a number n of radially projecting sockets, distributed peripherally in a star arrangement, designed for the attachment of one end of a horizontal crosspiece of the scaffolding; the sockets are defined by a metal strip folded in order to form a star-shaped part closed on itself having protuberances forming the said sockets alternating with re-entrant regions bearing against the tubular portion, the upper and lower edges of the re-entrant regions in contact with the tubular portion being welded thereto by continuous or discontinuous annular weld beads.

7 Claims, 2 Drawing Sheets

FIG. 1A
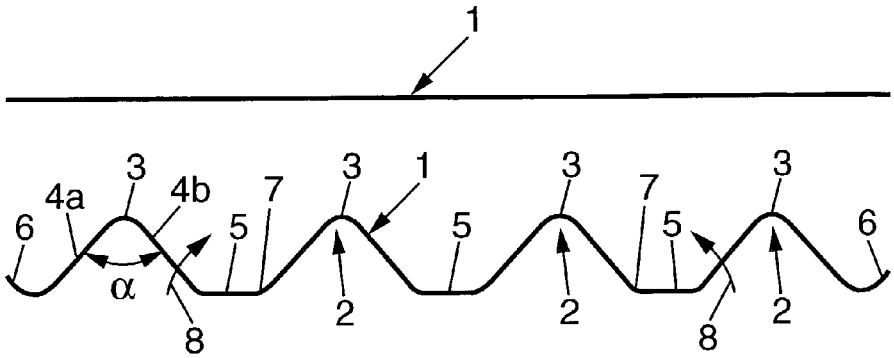
FIG. 1B
FIG. 1C
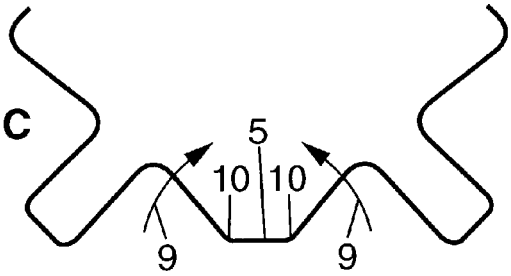
FIG. 1D
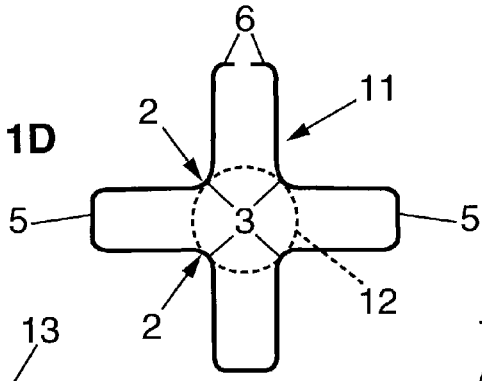
FIG. 1E
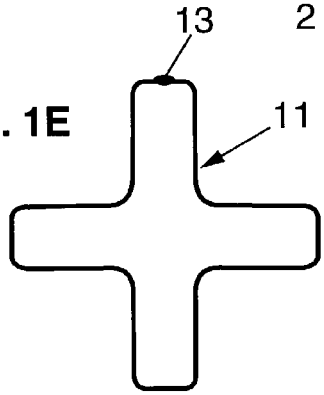
FIG. 1F
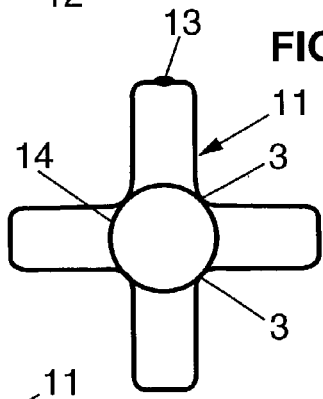
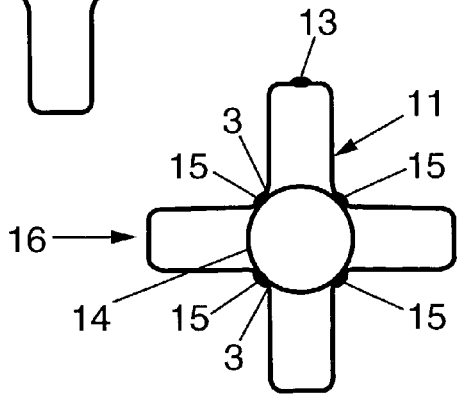
FIG. 1G

METHOD OF MANUFACTURING A VERTICAL SCAFFOLDING ELEMENT, AND ELEMENT THUS OBTAINED

FIELD OF THE INVENTION

The present invention relates to the field of scaffolding and, more specifically, it relates to improvements made to the vertical scaffolding elements consisting of a tubular portion provided with a certain number of radially projecting sockets, distributed peripherally in a star arrangement, intended for the attachment of one end of a horizontal transverse member of the scaffolding.

DESCRIPTION OF THE PRIOR ART

Scaffolding elements of the type in question are described and shown, for example, in document FR-A-1 521 232.

In the scaffolding elements of the type in question which are currently used, the sockets are manufactured individually, from a folded metal plate in the form of a U-shaped yoke, then welded individually to the tubular portion. Each edge of the U-shaped yoke is welded to the tubular portion both externally and possibly internally.

This results, for a scaffolding element equipped with four sockets placed in a cross arrangement, in the need to produce eight linear weld lines extending longitudinally. In addition, the production of internal welds is complex and requires specific equipment capable of being engaged inside the sockets.

The manufacture of this type of equipment proves to be difficult, lengthy and expensive.

Documents GB-A-2 207 875 and FR-A-1 553 487 certainly show arrangements of scaffolding elements comprising a part shaped into a star arrangement, defining radial sockets for the attachment of transverse member(s) However, these star-shaped parts have a geometrical shape which does not allow easy manufacture with simple equipment by an unskilled worker.

SUMMARY OF THE INVENTION

The aim of the invention is to overcome these drawbacks and to provide an improved solution suitable for simplifying the manufacturing process, and in rendering it shorter, simpler and therefore less expensive.

To these ends, according to a first of its aspects, the invention provides a method of manufacturing a vertical scaffolding element consisting of a tubular portion to which is welded a star-shaped part defining a number n of radially projecting sockets, distributed peripherally in a star arrangement, intended for the attachment of one end of a horizontal crosspiece of the scaffolding, the said process consisting in stamping flat a plane metal strip of a predetermined length at n regularly spaced locations so as to form n recesses, then in folding the said strip shaped in this way in order to close it on itself and to form a star-shaped part, and finally to position the latter on the said tubular portion and to weld it thereto, method wherein, according to the invention, said strip is stamped at n regularly spaced locations so as to form n recesses approximately in a dihedral arrangement with a rounded ridge transverse to the length of the strip, wherein said strip stamped in this way is folded at the joins of the ends of the faces of the dihedra with the intermediate plane regions of the strip so as to bring closer to each other the lateral faces of two adjacent recesses which are located on each side of a plane region of the strip and so as to position the rounded ridges of the recesses on an axisymmetric cylindrical outline having substantially the same diameter as the external diameter of the tubular portion, and wherein, after welding the abutted ends of the strip to each other and positioning the star-shaped part onto the tubular portion with the rounded ridges of the dihedra formed by the recesses placed bearing against the outer face of the tubular portion, the said star-shaped part is secured to the tubular portion by discontinuous circular welds made on the upper and lower edges of the rounded ridges in contact with the tubular portion.

By virtue of the invention, the sockets are no longer manufactured and secured individually to the tubular portion by a high number of longitudinal welds, but they result from the production of a star-shaped part; and in addition, this star-shaped part is obtained by simple stamping and folding operations on an initially flat metal strip, which part is then welded to the tubular portion by a small number of circular arc-shaped welds which can be produced quickly with simple equipment, and without the need for skilled personnel.

The cost of manufacturing a scaffolding element by implementing the method of the invention is considerably reduced, at the same time, the element is manufactured in a much shorter period of time.

A considerable advantage will also be noted as regards safety. If a socket is torn off—that is to say that its welds to the tubular portion are broken—for example under the effect of too high a force, the torn socket continues to be integral with the rest of the part which, itself, remains secured to the tubular portions by its other welds. Thus, a crosspiece bearing on the torn socket is prevented from collapsing, as would happen with individual sockets.

In a simple manner, provision is made that the recesses are formed as dihedra which are open over an angle of $2\pi/n$.

Also, advantageously, the stamped strip is folded so as to bring the lateral faces of two adjacent recesses into a substantially parallel mutual position.

In a preferred embodiment which seems to constitute the most common practical application of the invention, provision may be made for the number of recesses to be four and for the angle $\alpha$ of opening of the dihedra formed by the recesses to be about 90°, by virtue of which a vertical scaffolding element is obtained, consisting of a tubular portion equipped with four sockets placed substantially in a cross arrangement.

Preferably, the metal strip is treated such that the said abutted ends of the strip which are welded are located away from the end of a socket, so that the weld bead does not hamper the attachment of the additional scaffolding members to the socket. Advantageously, there will be a benefit in that the welded abutted ends of the strip are located in a region of the star-shaped part which bears against the tubular portion, such that the upper and lower ends of the weld bead are remelted during subsequent welding of the star-shaped part to the tubular portion.

According to a second one of its aspects, the invention provides a vertical scaffolding element comprising four sockets defined by a metal strip folded in a cross arrangement with orthogonal branches and welded to a tubular portion which is characterized in that it is manufactured by implementing the method described above.

BRIEF DESCRIPTION OF THE DRAWINGS

The invention will be better understood on reading the following detailed description of certain embodiments given by way of purely illustrative example. In this description, reference is made to the appended drawings in which:

FIGS. 1A to 1G illustrate successive steps in the manufacture of a preferred embodiment of a vertical scaffolding element according to the invention;

DETAILED DESCRIPTION OF THE INVENTION

Figure 2:
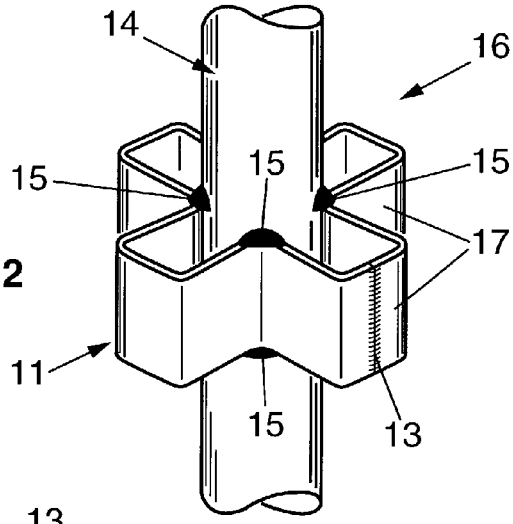
FIG. 2 is a perspective view of a vertical scaffolding element constructed according to the invention.

The method of the invention will now be explained with reference to FIGS. 1A to 1G, by considering more particularly a preferred embodiment with four sockets placed substantially in a cross arrangement, that is to say diametrally opposed in pairs along two perpendicular branches, since this is the configuration which, in practice, seems to have the most widespread application.

Initially, a plane metal strip 1 of a predetermined length (FIG. 1A, together with the following figures, in which the metal strip 1 is shown with no thickness, by a single line, for reasons of clarity) is formed.

Next, diagonal bolt housings are punched out, this punching thus being carried out flat, under proper conditions.

Then, the said strip 1 is flat-stamped at n (in this case four) regularly spaced locations so as to form n recesses 2 approximately in a dihedral arrangement with a rounded ridge 3 extending transversely for the length of the strip 1.

Preferably, the dihedral recesses 2 are open over an angle $\alpha=2\pi/n$, which, in the case illustrated, is an angle of about 90°.

As can be seen in FIG. 1B, each dihedral recess 2 is therefore defined by two substantially plane walls 4*a*, 4*b* which are mutually inclined by the said angle $\alpha=2\pi/n$ and which are joined by the rounded ridge 3. Two successive recesses 2 are separated by a flat undeformed region 5 of the strip 1. At the ends of the strip 1, a short portion 6 is stamped substantially perpendicular to the wall 4*a* or 4*b* of the adjacent recess 2.

Next, on the strip stamped in this way with its recesses 2, a bending or folding operation is carried out on the strip by folding the metal strip at the joins of the ends of the faces 4*a*, 4*b* of the recesses with the intermediate flat regions 5 so as to bring closer to each other successive lateral faces 4*a*, 4*b* belonging respectively to two adjacent recesses which are located on each side of a flat region 5.

In the example with four recesses taken into consideration here, the bending or folding operation is carried out in two steps.

In FIG. 1C, initially the two ends of the strip are folded by pivoting (arrow 8) the respective extreme recess 2 and the adjacent flat region 5 about the join 7 of the said flat region 5 with the adjacent recess 2.

Then, on the intermediate part thus obtained (FIG. 1C), the two parts surrounding the central flat region 5 are folded by pivoting (arrow 9) about the joins 10 of the said parts with the said central flat region 5.

Following on from this, a star-shaped part 11 provided with n branches mutually separated by an angle of $2\pi/n$ is obtained. In the example in question here, the star-shaped part 11 is cross-shaped with opposed arms, offset by 90°, as illustrated in FIG. 1D. The short portions 6 of the ends of the strip 1 are abutted in order to form one end of one of the branches.

The star-shaped part 11 is finished by welding, at 13, the aforementioned ends 6 edge to edge, such that an integral star-shaped part 11 is obtained, consisting of a metal strip closely following a closed outline with a complex shape as illustrated in FIG. 1E (in this case, the part 11 has a cross section in the form of a cross with four branches).

In addition, it will be noted that the rounded ridges 3 of the dihedral recesses 2 are all positioned on an axisymmetric cylindrical outline, the dimensions of the various deformed/folded parts of the strip 1 being chosen such that this cylindrical contour 12 (drawn in dotted lines in FIG. 1D) has substantially the same diameter as the external diameter of a tubular mounting portion.

Then, the star-shaped part 11 is pulled over and positioned on a tubular metal portion 14 (FIG. 1F), the rounded ridges 3 of the dihedra formed by the initial recesses 2 bearing against the outer face of the tubular portion 14. It may be emphasized here that there is a benefit in the cylinder of revolution 12 for positioning the rounded ridges 3 having a diameter which is very slightly less than that of the outer face of the tubular portion 14 so that the star-shaped part 11 elastically clamps the tubular portion 14 over which it is fitted: the star-shaped part 11 then remains in place without any other retaining means for the purpose of the following operation.

Finally, the star-shaped part 11 is welded to the tubular portion 14: weld beads 15 (FIG. 1G) are deposited, in two circular passes, on the upper and lower edges of the rounded ridges 3, that is at eight locations in the example illustrated in FIG. 1G.

Following on from which, a vertical scaffolding element is obtained, as illustrated in FIG. 2, denoted overall by the reference 16, which consists of a tubular portion 14 provided with a number n (in this case four) of radially projecting sockets 17 distributed peripherally in a star arrangement, the said sockets being intended for the attachment of one end of a horizontal crosspiece of the scaffolding. The configuration of the star-shaped part 11 and its weld to the tubular portion 14 by upper and lower circular arc-shaped weld beads 15 are clearly visible in FIG. 2.

The method of the invention overcomes the drawbacks associated with the manufacture and the securing of individual sockets. It makes it possible to manufacture all of the sockets 17 integrally, it being possible for the star-shaped part 11 to be obtained by implementing simple mechanical processes. Furthermore, its attachment to the tubular portion requires two welding operations carried out discontinuously, in a circular manner, over the periphery of the tubular portion, and therefore under very simple conditions. These two welding operations may be carried out in a single pass by using two welding apparatuses, or else in two successive passes.

In the example envisaged above with regard to FIGS. 1A to 1G and 2, it has been assumed that the sockets have substantially parallel lateral faces, the folding operations (FIGS. 1C and 1D) being carried out as a consequence.

Figure 3:
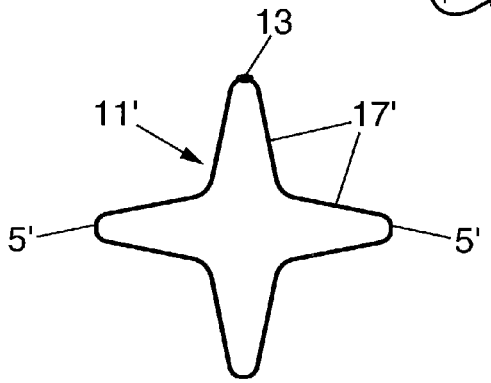
FIGS. 3 and 4 are, respectively, two schematic views of variant embodiments of the star-shaped part of FIG. 1E.

However, the invention is not limited to this single configuration and it is possible to envisage an implementation of the method of the invention capable of leading to a star-shaped part 11', the branches 17' of which have a different shape, for example a tapered shape, as illustrated schematically in FIG. 3. The branches 17' may have convergent walls joined at their end by a flattened transverse part 5' having a width less than the part 5 provided in FIGS. 1A to 1G and 2. Even the transverse part 5' may be reduced to nothing with the convergent walls joining at a point. As a consequence, all that is needed for this is to adapt the stamping operation of FIG. 1B (recesses 2 fairly close together, or even touching), and to adapt the folding operations of FIGS. 1C and 1D (bringing the walls 4*a*, 4*b* closer together so that they converge without becoming parallel).

Figure 4:
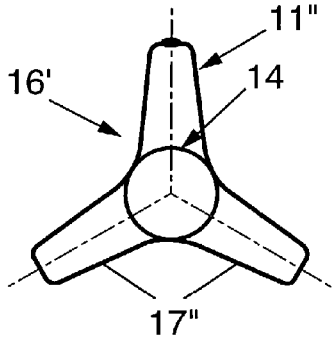

Furthermore, the invention is not limited to the manufacture of vertical scaffolding elements equipped with four sockets. It is possible, by the method of the invention, to manufacture elements having any number n of sockets spaced apart by an angle of $2\pi/n$; in this case, the recesses 2 are formed, at the stamping step of FIG. 2, with side walls 4*a*, 4*b* forming an angle of $2\pi/n$ between them. By way of example, FIG. 4 illustrates schematically the shape of a vertical element 16' incorporating a star-shaped part 11" defining three sockets 17" separated by 120°, with convergent side walls according to the arrangements of FIG. 3.

Figure 5:
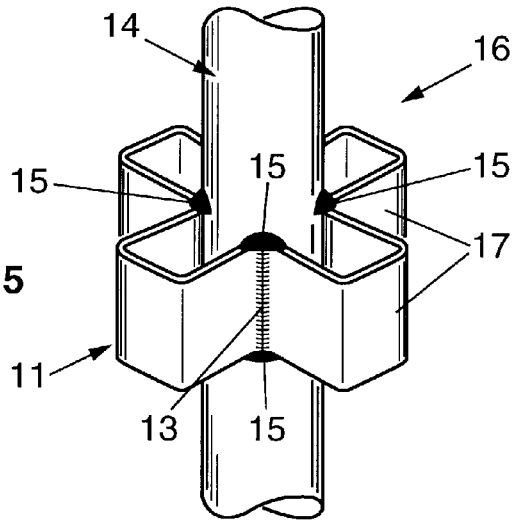
FIG. 5 is a perspective view similar to that of FIG. 2, showing a preferred variant embodiment.

In the exemplary embodiments which have just been described and which are illustrated in FIGS. 1A–1G and 2 to 4, the abutted ends of the metal strip folded according to the method of the invention are located approximately on the end of a socket. The weld bead 13 securing these ends risks causing problems for the attachment to the socket of scaffolding members. It may therefore prove desirable to make sure that the said abutted ends are located away from the end of the socket, for example laterally, or even preferably in a region of the star-shaped part 11 which bears against the tubular portion (that is to say in the re-entrant angle separating two consecutive sockets), as is clearly illustrated in FIG. 5. In such an arrangement, the upper and lower ends of the weld 13 are remelted when welding the star-shaped part 11 on the tubular portion, which favourably affects the quality of these welds.

Figure 6:
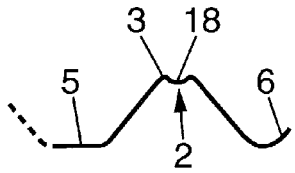
FIG. 6 is a schematic view of an alternative shape of the rounded ridges.

Finally it may prove to be particularly beneficial, as illustrated in FIG. 6, for the rounded ridges 3 to be shaped with their concavity turned outwards, such that these ridges 18 with a concave shape better follow the cylindrical outline of the tubular portion 14 to which they are applied and welded.

What is claimed is:

1. A method of manufacturing a vertical scaffolding element having a tubular portion to which is welded a star-shaped part defining a number n of radially projecting sockets, said sockets being distributed peripherally in a star arrangement and intended for attachment to one end of a horizontal crosspiece of a scaffolding, said method comprising the steps of:

stamping a plane metal strip of a predetermined length at n regularly spaced locations so as to form a stamped strip with n recesses, folding said stamped strip in order to close said stamped strip on itself at abutted ends and hence to form the star-shaped part, and positioning the star-shaped part on said tubular portion and welding the star-shaped part thereto, wherein said step of stamping said strip at n regularly spaced locations so as to form n recesses forms each said recess approximately in a dihedral arrangement with a rounded ridge transverse to a length of the strip and with opposed lateral faces connected at ends thereof by joins to intermediate plane regions of the strip, wherein said folding step folds said strip stamped in the stamping step at the joins of the ends of the faces of the dihedral arrangement with the intermediate plane regions of the strip so as to bring closer to each other the lateral faces of two adjacent recesses which are located on each side of a plane region of the strip and so as to position the rounded ridges of the recesses on an axisymmetric cylindrical outline having substantially a same diameter as an external diameter of the tubular portion, wherein said stamping step is conducted in such a manner that the abutted ends of the strip are not located in one of said recesses, and wherein said welding step includes a) initially welding said abutted ends of the strip to each other, b) positioning the star-shaped part onto the tubular portion with the rounded ridges of the dihedra arrangement formed by the recesses placed bearing against an outer face of the tubular portion, and c) securing said star-shaped part to the tubular portion by discontinuous circular welds made on upper and lower edges of the rounded ridges in contact with the tubular portion.

2. The method according to claim 1, wherein said recesses are formed as dihedra which are open over an angle of $2\pi/n$.

3. The method according to claim 1, wherein said stamped strip is folded so as to bring the lateral faces of two adjacent recesses into a substantially parallel mutual position.

4. The method according to claim 1, wherein the number of recesses is four and wherein the angle $\alpha$ of opening of the dihedral arrangement formed by the recesses is about 90°, whereby the vertical scaffolding element has the tubular portion equipped with four sockets placed substantially in a cross arrangement.

5. The method according to claim 1, wherein the metal strip is folded such that said abutted ends of the strip which are welded are located at the end of a socket.

6. The method according to claim 1, wherein the metal strip is folded such that said abutted ends of the strip which are welded are located away from the end of a socket, but not in a region which bears against the tubular portion.

7. The method according to claim 1, wherein said rounded ridges are formed with their concavity turned outwards, so that these ridges can be applied tightly against the tubular portion.

* * * * *